US005571064A

United States Patent [19]

Holm

[11] Patent Number: 5,571,064

[45] Date of Patent: Nov. 5, 1996

[54] ELASTIC EXERCISE DEVICE WITH SEGMENTED HANDLE

[76] Inventor: James E. Holm, 1754 River Point Loop, Eugene, Oreg. 97401

[21] Appl. No.: 451,126

[22] Filed: May 26, 1995

[51] Int. Cl.[6] ..... A63B 21/04

[52] U.S. Cl. ..... 482/129; 482/126; 482/904

[58] Field of Search ..... 482/121, 122, 482/124, 126, 904

[56] References Cited

U.S. PATENT DOCUMENTS

| | | | |
|---|---|---|---|
| D. 234,309 | 2/1975 | Buchner | 482/126 |
| 775,989 | 11/1904 | Roberts . | |
| 3,196,825 | 7/1965 | Spurlock . | |
| 3,219,007 | 11/1965 | Kiefer . | |
| 3,304,904 | 2/1967 | Spurlock . | |
| 4,392,833 | 7/1983 | Hayden . | |
| 4,722,523 | 2/1988 | Yang | 482/126 |
| 4,733,861 | 3/1988 | Plunkett, III | 482/126 |
| 4,733,862 | 3/1988 | Miller . | |
| 4,779,867 | 10/1988 | Hinds | 482/904 |
| 4,867,722 | 9/1989 | Joseph . | |
| 5,176,602 | 1/1993 | Roberts . | |
| 5,254,065 | 10/1993 | Pollock . | |

*Primary Examiner*—Lynne A. Reichard
*Attorney, Agent, or Firm*—James D. Givnan, Jr.

[57] ABSTRACT

The handle of the device includes several segments joined by connectors which permit disassembly and use of certain segments as individual handles. An elastic cord terminates in securement to certain of said segments and passes through a loop which serves to anchor the cord to a stationary object. The loop is formed with an enlarged portion to permit removable securement of the loop between a door and door jamb. The loop may also be placed about a user's foot during certain exercises. The connectors may have a castellated exterior for gripping purposes.

3 Claims, 1 Drawing Sheet

ELASTIC EXERCISE DEVICE WITH SEGMENTED HANDLE

BACKGROUND OF THE INVENTION

The present invention pertains generally to exercise devices of the type including an elastic cord.

In U.S. Pat. No. 775,989, an exercising device is disclosed as having a pair of handles each attached to an elastic cord with the cords attached at their remaining ends to a bracket held in place by a door and door jamb.

U.S. Pat. No. 5,254,065 disclsoes a loop for engagement with a door and jamb to support hooks with pulleys on which is entrained a cord for lifting of weights.

U.S. Pat. No. 4,733,862 discloses an exercising device with handles in place on an elastic cord. A flexible band 7 anchors the cord to a door hinge.

U.S. Pat. Nos. 4,867,722; 4,392,833; 3,304,904; 3,219,007; and 3,196,825 all show water ski rope handles which may be separated to provide separate handles to facilitate certain types of water skiing maneuvers.

U.S. Pat. No. 5,176,602 shows an exercising device with a door secured loop having a knotted portion to prevent passage past a closed door edge. The loops each support an elastic band fitted with handles for each hand.

SUMMARY OF THE PRESENT INVENTION

The present invention is embodied in a device directed toward providing a device enabling the user to exercise a wide range of muscles without the use of costly equipment.

A segmented handle of the present device permits exercising of the arms and legs jointly or, upon handle separation, exercising the same individually. Handle segments are joined by connectors which, upon separation, permit operation of a pair of segments with each segment having ends of an elastic cord secured thereto. The connectors may be provided in the form of grips with grooved surfaces for non-slip gripping. Additionally the device includes a loop for cord attachment to an anchoring structure such as a door and door jamb with the loop having a serpentine segment stitched to provide a retainer for the loop.

Important objectives include the provision of an exercising device particularly suited for those in need of therapeutic exercise to improve strength, endurance, range of motion and movement dynamics by providing a device of light weight having light resistance permitting a high number of repetitive movements; the provision of a device utilizing a loop through which an elastic cord is entrained and which may be secured in a door jamp or other type anchor as well as placed about a foot either to anchor the loop or, performing leg exercises, against the action of the elastic cord.

DETAILED DESCRIPTION OF THE PREFERRED EMBODIMENTS

Figure 1:
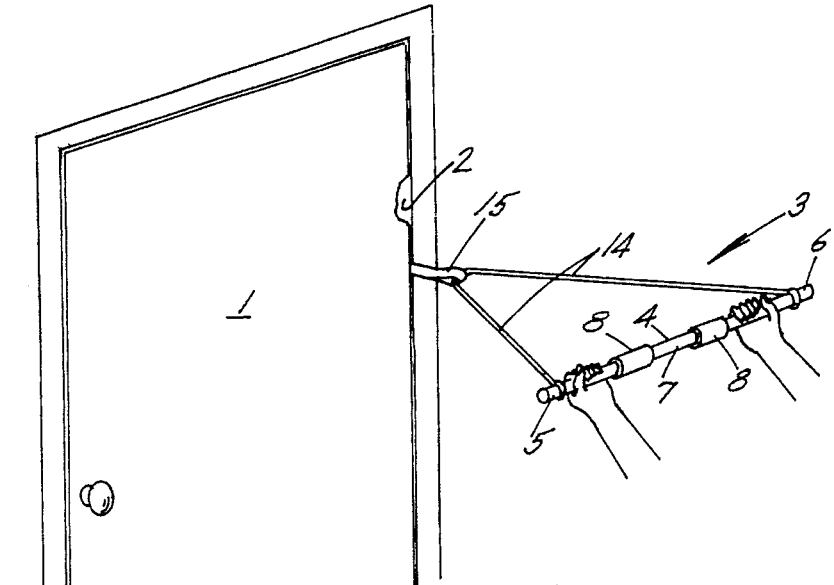
FIG. 1 is a perspective view of the present exercising device operatively secured in place between a door and a door jamb.
Figure 2:
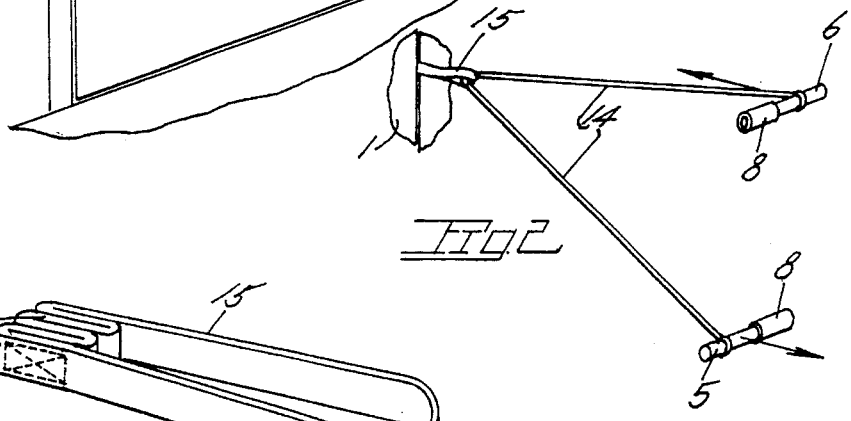
FIG. 2 is a view similar to FIG. 1 but with the handle separated into two handles.
Figure 3:
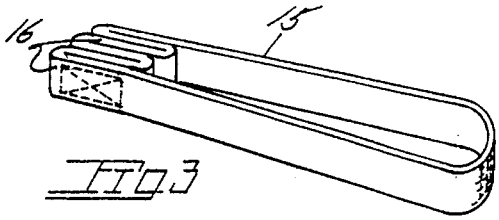
FIG. 3 is a perspective view of a loop through which an elastic cord passes.

With continuing attention to the drawings, the reference numeral 1 indicates a door closed within a jamb 2 in a room wall.

The present exercising device is indicated generally at 3 and includes a handle assembly 4. Handle assembly 4 comprises end segments 5, 6 and a middle segment 7 each elongate and preferably cylindrical.

Connectors at 8 of the handle assembly serve to couple the handle segments to provide a rigid handle of a length to permit convenient grasping of the end segments with the user's arms extended in a generally parallel manner. The connectors are internally threaded at 9 to receive threaded end segments as at 10 and 11 of the handle segments. A shoulder as at 12 at each of the coupled ends of the handle segments abuts a connector end as at 13 to support the segment against bending loads during use of the device. The exterior of each connector may be castellated as at 8A for gripping purposes.

Affixed to end segments 5 and 6 of the handle assembly are the ends of an elastic cord 14, preferably of tubular construction, with the cord ends tied in place or otherwise suitably affixed adjacent the ends of said end segments.

Figure 6:
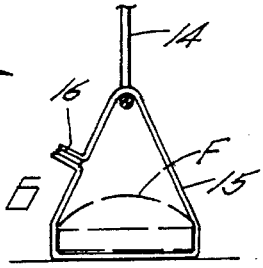
FIG. 6 is an elevational view of the loop held in place by a user's foot.
Figure 4:
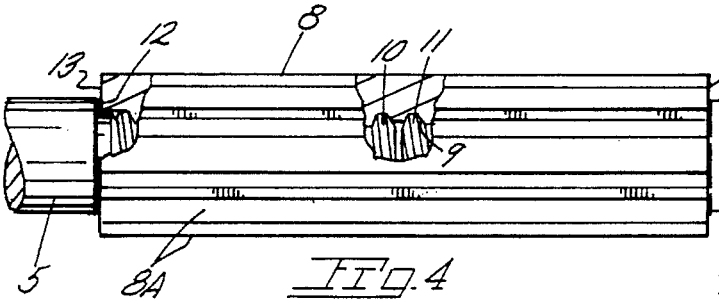
FIG. 4 is a front elevational view of a connector for joining handle segments.
Figure 5:
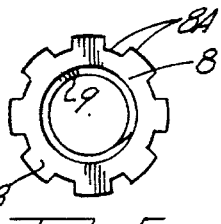
FIG. 5 is an end elevational view of FIG. 4.

A loop at 15 is of fabric construction and receives a cord 14. For loop retention, the same includes a folded and stitched portion at 16 to provide a stop for the loop when the two runs of the loop are confined between an edge of door 1 and the opposed jamb 2. Loop 15 may also receive a user's foot per FIG. 6 during certain exercises.

While I have shown but one embodiment of the invention, it will be apparent to those skilled in the art that the invention may be embodied still otherwise without departing from the spriit and scope of the invention.

Having thus described the invention, what is desired to be secured by a Letters Patent is:

I claim:

1. An exercise device comprising, a handle assembly having aligned segments including a middle segment and end segments all with threaded end segments, internally threaded connectors spaced along said handle assembly and coupling said aligned segments, said aligned segments each including a shoulder for supported abutment with one or more of said connectors, an elastic cord having ends attached to said end segments, a loop through which the cord passes and including an enlarged portion for abutment against a stationary object, and said middle segment detachable from the end segments and permitting independent movement of said end segments by the user during exercising.

2. The device claimed in claim 1 wherein said loop is of fabric construction having a folded and stitched portion for abutment purposes.

3. The device claimed in claim 1 wherein said connectors include a castellated exterior to enhance gripping of the connectors by a user.

* * * * *